US005932084A

United States Patent [19]

Takamaru

[11] Patent Number: 5,932,084

[45] Date of Patent: Aug. 3, 1999

[54] PROCESS FOR PRODUCING RARE EARTH METALS

[75] Inventor: Kiyofumi Takamaru, Kobe, Japan

[73] Assignee: Santoku Metal Industry Co., Ltd., Kobe, Japan

[21] Appl. No.: 08/879,568

[22] PCT Filed: Oct. 24, 1996

[86] PCT No.: PCT/JP96/03104

§ 371 Date: Jun. 20, 1997

§ 102(e) Date: Jun. 20, 1997

[87] PCT Pub. No.: WO97/15701

PCT Pub. Date: May 1, 1997

[30] Foreign Application Priority Data

Oct. 25, 1995 [JP] Japan ..... 7-278021

[51] Int. Cl.[6] ..... C25C 3/00; C25C 3/34

[52] U.S. Cl. ..... 205/368

[58] Field of Search ..... 205/368

[56] References Cited

U.S. PATENT DOCUMENTS 3,383,294 5/1968 Wood ..... 205/368

4,966,662 10/1990 Tamamura ..... 205/368 X 5,258,103 11/1993 Endoh et al. ..... 205/368 X

FOREIGN PATENT DOCUMENTS 6-280077 10/1994 Japan .

562777 7/1944 United Kingdom ..... 205/368

*Primary Examiner*—Donald R. Valentine

*Attorney, Agent, or Firm*—Darby & Darby

[57] ABSTRACT

A process for producing rare earth metals including the step of electrolyzing a starting material containing rare earth carbonates as main ingredients in a molten salt electrolytic bath containing rare earth fluorides, lithium fluoride, and barium fluoride at a bath temperature of 750 to 950° C. while adjusting an anode potential to an electrolytic potential of fluorides. This method allows production of rare earth metals at a high current density and a high current efficiency, while ensuring prolongation of life time of an electrolytic cell and electrodes by performing the electrolysis at a lower bath temperature, and suppressing generation of toxic fluorine-containing gases.

8 Claims, 1 Drawing Sheet

PROCESS FOR PRODUCING RARE EARTH METALS

BACKGROUND ART

The present invention relates to a process for producing rare earth metals including rare earth-containing alloys which can be used for rare earth-containing alloy magnets, hydrogen storage alloys for anodes of nickel-hydrogen rechargeable batteries, and the like.

Rare earth metals are used in a wide variety of usage such as lighter flints or steel refining additives. It is known that such rare earth metals can be produced by a molten salt electrolysis of rare earth chlorides. Recently, rare earth element-transition metal alloys have been developed for permanent magnets providing high performance, and samarium-cobalt magnets, neodymium-iron-boron magnets and the like have been put into practice. Alternatively, hydrogen storage alloys providing high performance such as a lanthanum-nickel alloy and a misch metal (mixed rare earth metals)-nickel alloy have been put to use in a large amount as anode materials for nickel-hydrogen rechargeable batteries. Rare earth metals used in these alloys are required to have high quality, but the rare earth metals produced by the molten salt electrolysis of rare earth chlorides contain a quantity of impurities such as chlorine, oxygen, or the like, so that performance of such rare earth metals cannot be improved sufficiently.

In order to overcome this problem, electrolysis in a fluoride molten salt bath with a charge of oxides have been developed (E. S. Shedd, J. D. Marchant, M. M. Wong: U.S. Bureau of Mines RI 7398 P.3 (1970)), and performed in an industrial scale (*Electrochemistry Handbook, Fourth Edition*, Edited by The Electrochemical Society of Japan, Published by Maruzen Co., Ltd., P.399 (1985)) for producing a large amount of misch metals. According to this method, a mixed salt consisting of 50 to 75% by weight of rare earth fluorides, 15 to 30% by weight of lithium fluoride, and 10 to 20% by weight of barium fluoride, is charged into an electrolytic cell made of a refractory material, and heated to 850 to 1000° C. for melting the mixed salt. Then, while bastnasite ore previously calcined and refined or refined rare earth oxides are charged into the heated and molten mixed salt, electrolysis is performed at a voltage of 6 to 12 V, an anodic current density of 0.5 to 1 A/cm$^2$, and a cathodic current density of 1 to 10 A/cm$^2$, using a graphite anode and a molybdenum cathode, to thereby electrodeposit and recover misch metal. In this electrolytic reaction, the oxides dissolved in the fluoride molten salt is electrolyzed in accordance with a reaction formula $2\ Mm_2O_3 \rightarrow 4\ Mm+3O_2$ to form misch metal (Mm). The oxygen in the oxides reacts with graphite in the anode in accordance with a reaction formula $3O_2+3C\ (\text{anode}) \rightarrow 3CO_2\uparrow$ to become carbonic acid gas, and exits the reaction system.

Alternatively, if the electrolysis in a fluoride molten salt bath with a charge of oxides is applied for producing a neodymium metal used as a neodymium-iron-boron magnet material or the like, neodymium will precipitate in a solid state at the electrolytic temperature of the misch metal since the melting point of the neodymium metal is as high as 1050° C., and recovery of neodymium metal will be difficult. Thus, the electrolysis should be performed at an elevated temperature. The electrolytic reaction proceeds in accordance with a reaction formula $2Nd_2O_3 \rightarrow 4Nd+3O_3$, and oxygen in the oxides reacts with graphite in the anode as in the case using the misch metal, to become carbonic acid gas, and exits the system. The neodymium metal can be produced in an electrolytic cell equipped with a consumable cathode. In particular, if the neodymium metal is to be produced in the form of an alloy of neodymium and iron, using an iron cathode as the consumable cathode, under the conditions to set the iron content of the alloy to be 10 to 20% by weight, the melting point of the alloy is as low as 750 to 850° C. Therefore, in this case, the neodymium metal can be recovered as a molten alloy even at a temperature as low as the electrolytic temperature for producing the misch metal. In this process, the cathodic reaction proceeds in accordance with a reaction formula $Nd+xFe \rightarrow NdFe_x$. The recovered neodymium-iron alloy can be used as a master alloy such as a material for neodymium-iron-boron magnets.

If a nickel cathode is used in this method as the consumable electrode, a rare earth metal-nickel alloy can be obtained in accordance with a reaction formula $R+xNi \rightarrow RNi_x$. (R: rare earth metals)

In the above electrolytic reaction, the reaction proceeds as the charged rare earth oxides are dissolved in the fluoride molten salt bath and ionized. Thus, if the electric current is supplied at a rate higher than the dissolving rate of the oxides, the dissolved oxides are running short, which causes anode effect (wherein the anode is covered with inactive gas produced by the reaction, thereby being insulated), thereby stopping the electrolytic reaction. On the other hand, it is reported that undissolved rare earth oxides react with the fluorides in the electrolytic bath in accordance with a reaction formula $Nd_2O_3+NdF_3 \rightarrow 3NdOF$ to form oxyfluorides, which are not electrolyzed (Report of Molten Salt Committee of The Electrochemical Society of Japan, "Yoyuen oyobi Koon Kagaku (Molten Salt and Pyrochemical)" Vol. 38, No. 1, P.48 (1995)).

Accordingly, it is necessary in the electrolysis in a fluoride molten salt bath with a charge of oxides to dissolve rare earth oxides in the fluoride molten salt bath in an amount corresponding to the supply of the electrolytic current. Also inthisprocess, dissolution of rare earth oxides takes time since the rare earth oxides are first dissolved in the molten salt bath and then dissociated into ions. Thus, before completely dissolved, the rare earth oxides are sedimented at the bottom of the electrolytic cell to form a slug, thereby interrupting a prolonged electrolysis.

Improvements have been proposed, such as electrolysis of fluorides using rare earth fluorides in place of rare earth oxides (Japanese Laid-open Patent Application Nos. 61-87888 and 61-266086, and U.S. Pat. No. 496661 (1990)). Such electrolysis of fluorides, however, has some disadvantages, namely: the rare earth fluorides used in the process are more expensive than the oxides; and the gas produced by the electrolysis is a fluorine gas, which requires expensive facilities for exhaust gas treatment in order to prevent pollution.

Alternatively, in order to improve solubility of the rare earth oxides in the electrolysis with a charge of oxides, there has been proposed an electrolytic reduction method using $Re_2O_2CO_3$ (Re stands for rare earth elements) as the starting material (Japanese Laid-open Patent Application No. 6-280077). This method has an advantage in that dissolution of rare earth oxides which are produced by decomposition of the charged $Re_2O_2Co_3$ is promoted under the similar conditions to those for the conventional electrolysis with a charge of oxides at the bath temperature of about 1000° C. However, since this method employs a high temperature bath as in the conventional method, the problems relating to shortening of life time of the electrolytic cell and electrodes are not solved. Accordingly, this method is not substantially improved in regard of this point.

DISCLOSURE OF THE INVENTION

Therefore, it is an object of the present invention to provide a process for producing rare earth metals including rare earth-containing alloys which allows electrolytic production of rare earth metals at a high current density and a high current efficiency, while ensuring prolongation of life time of an electrolytic cell and electrodes by performing the electrolysis at a lower bath temperature, and suppressing generation of toxic fluorine-containing gases.

According to the present invention, there is provided a process for producing rare earth metals comprising the step of electrolyzing a starting material containing rare earth carbonates as main ingredients in a molten salt electrolytic bath containing rare earth fluorides, lithium fluoride, and barium fluoride at a bath temperature of 750 to 950° C. while adjusting an anode potential to an electrolytic potential of fluorides.

PREFERRED EMBODIMENTS OF THE INVENTION

Figure 1:
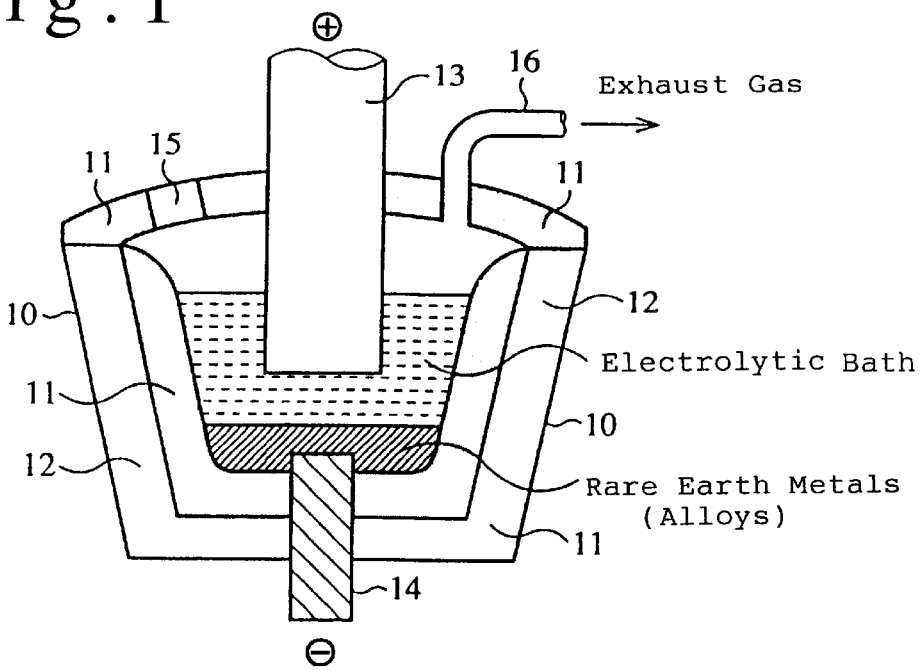
FIG. 1 is a schematic view showing a molten salt electrolytic cell equipped with upper and lower electrodes, as an example of the electrolytic cell used in the present invention.

The rare earth metals produced according to the present invention includes in its concept La, Ce, Pr, Nd, Gd, Dy, Ho, Er, Tm, Yb, Lu, Y, Sc, or mixtures thereof, and alloys of these metals with transition metals such as Fe, Ni, Co, and Mn and/or with metals such as Al, Mg, and Zn, which are used in the conventional electrolysis in a fluoride molten salt bath with a charge of oxides.

In the present process, the starting material to be subjected to electrolysis contains rare earth carbonates as main ingredients, and most preferably consists of 100% of rare earth carbonates. But a starting material containing not less than 70% by weight, more preferably not less than 80% by weight of rare earth carbonates can also be used. In addition to the rare earth carbonates, the starting material may further contain rare earth oxides or the like which are conventionally used in the electrolysis in a molten salt electrolytic bath. The content of such material other than the rare earth carbonates in the starting material is not particularly limited as long as the effects of the present invention can be obtained, but is preferably up to 30% by weight, more preferably up to 20% by weight.

The rare earth carbonates are not particularly limited as long as they-are carbonates of rare earth metals. Examples of the rare earths include La, Ce, Pr, Nd, Gd, Dy, Ho, Er, Tm, Yb, Lu, Y, Sc, and mixtures thereof. The carbonates may be normal carbonates, monooxycarbonates, or dioxycarbonates of these rare earths, or mixtures thereof. However, if the rare earth carbonates contain moisture, such moisture may react with fluorine ions in the bath salt in the electrolytic cell to generate hydrogen fluoride gas. Thus, it is necessary to use rare earth carbonates containing as little residual crystal water as possible. Preferred moisture content of the rare earth carbonates is not more than 0.2% by weight.

The rare earth carbonates may be prepared by, for example, charging an alkali carbonate, preferably ammonium bicarbonate (ammonium hydrogencarbonate) into an aqueous solution of water soluble salts such as rare earth nitrates or rare earth chlorides to precipitate rare earth carbonates, rare earth bicarbonates, oxycarbonates, or mixtures thereof, separating the precipitate by filtration, and drying the precipitate by heating it at 150 to 700° C. for 1 to 10 hours. In the drying step, it is necessary to dry the precipitate so that the moisture content of the rare earth carbonates is as low as possible, as mentioned above. The rare earth carbonates to be obtained will be normal carbonates, monooxycarbonates, dioxycarbonates, or mixtures thereof, depending on the drying temperature. The temperature at which the normal carbonates are converted to monooxycarbonates or dioxycarbonates depends on the kind of rare earth elements. For example, if the rare earth is cerium, the conversion temperature is low, whereas if it is a heavy rare earth element, the conversion temperature is high. Therefore, such conditions may be taken into account in performing the drying step. The drying step may be performed in the atmosphere or under the reduced pressure.

In the process of the present invention, the molten salt electrolytic bath acts as a solvent for the starting material containing rare earth carbonates as main ingredients, and contains rare earth fluorides, lithium fluoride, and barium fluoride as electrolytic bath salts. Examples of the rare earth fluorides include, for example, a fluoride of La, Ce, Pr, Nd, Gd, Dy, Ho, Er, Tm, Yb, Lu, Y, or Sc, or mixtures thereof. It is preferred to use fluorides of rare earth elements (metals) having the same composition as that of the rare earth elements (metals) contained in the starting material for electrolysis such as the rare earth carbonates.

The composition of the electrolytic bath salt is not particularly limited, but usually a mixed salt of 50 to 75% by weight of rare earth fluorides, 15 to 30% by weight of lithium fluoride, and 10 to 20% by weight of barium fluoride is used. In the bath, up to 3% by weight of impurities such as alkali metal salts or alkaline earth metal salts may be present without any problem.

In the molten salt electrolytic bath containing the molten electrolytic bath salt, a metal capable of forming an alloy with the rare earth metals contained in the starting material such as the rare earth carbonates, may be present for producing the rare earth metals as a rare earth-containing alloy. Examples of such metal capable of forming an alloy with the rare earth metals include, for example, nickel, iron, cobalt, chromium, manganese, copper, aluminum, magnesium, zinc, or mixtures thereof. Zinc or the like, which has the melting point lower than the bath temperature of the molten salt electrolytic bath, may be present in a molten state. But usually, the metal is present in the solid state preferably on the surface of the cathode immersed in the molten salt electrolytic bath in the electrolytic cell to be described later.

According to the process of the present invention, the electrolysis of the starting material containing rare earth carbonates as main ingredients may be performed in an electrolytic cell used for the conventional electrolysis in a fluoride molten salt bath with a charge of oxides. Examples of the electrolytic cell include, for example, an electrolytic cell equipped with upper and lower electrodes as shown in FIG. 1, or an electrolytic cell equipped with electrodes arranged in parallel as shown in FIG. 2.

Specifically, the electrolytic cell shown in FIG. 1 has a steel plate 10, refractory cement 11, and an anode 13 and a cathode 14 placed at the top and the bottom, respectively, of the cell surrounded by an air-cooled chamber 12. On top of the cell, a port 15 for charging the starting material for the electrolysis and an exhaust pipe 16 are provided. On the other hand, the electrolytic cell as shown in FIG. 2 has a cathode 22 and anodes 23 on either sides of the cathode 22, all provided at the top of the cell enclosed in a refractory material 20 and a crucible 21. In FIG. 2, one cathode 22 and two anodes 23 are provided, but the numbers of the cathode and the anode are not particularly limited, so that a plurality of them may be combined and arranged. Below the cathode 22 is positioned a metal receiving vessel 24, and on top of the cell are provided a port 25 for charging the starting material for electrolysis and an exhaust port 26.

The most remarkable feature of the electrolysis operation of the present invention is to perform the electrolysis with the bath temperature of the fluoride molten salt bath being kept at 750 to 950° C., and the anode potential being adjusted to the electrolytic potential of fluorides. The above anode potential is a potential component, measured relative to a reference electrode, of potential difference between the anode and the cathode in the electrolytic bath (an electrolytic cell voltage or a potential between the electrodes) contributing to the electrode reaction (electrochemical reaction) at the anode. This potential is not a potential in an electrochemical sense, i.e. electrode potential (explained, for example, in *Electrochemistry Handbook, Fourth Edition*, p198 (1985)), but is a potential depending on a combination of a reference electrode and an electrolytic bath. Theoretical explanation of this potential can be found in detail in Masao Takahashi and Noboru Masuko, *Kogyo Denkai no Kaaaku (Chemistry of Industrial Electrolysis)*, p.10–16, AGNE (1986). In the present invention, the inventors paid attention to the anode potential in the fluoride molten salt bath. In an effort to develop a method for controlling the electrolytic conditions based on this anode potential, the inventors found that a method of using pure metal titanium as a reference electrode is most suitable for measuring the anode potential in a stable and reproducible manner. In practice, a pure titanium cylindrical rod with a diameter of 3 to 10 mm immersed in the bath near the anode in the electrolytic cell is connected to the minus terminal of a digital multi-meter (manufactured by ADVANTEST CO., LTD., trade name "R6341A") via a leading wire, and the anode is connected to the plus terminal of the device via a leading wire, to read the voltage across the two. Details of this method is described in "Electrochemistry of Rare Earth Fluoride Molten Salts" JALCOM 2063, 193(1993) p44–46. Through basic studies using this method, it was found that reaction at the anode includes two kinds of reactions, namely, decomposing reaction of fluorides and decomposing reaction of oxides, with the anode potential being about 4 to 6.5 V for the former and about 2 to 3.5 V for the latter. It is believed that the potentials have ranges because overvoltage due to the reaction resistance of the anode or the like is included in the potentials. According to the present invention, this anode potential is adjusted to be within the range of the electrolytic potential of fluorides, preferably within the range of 4 to 6.5 V, for achieving the effects to be described later.

Figure 2:
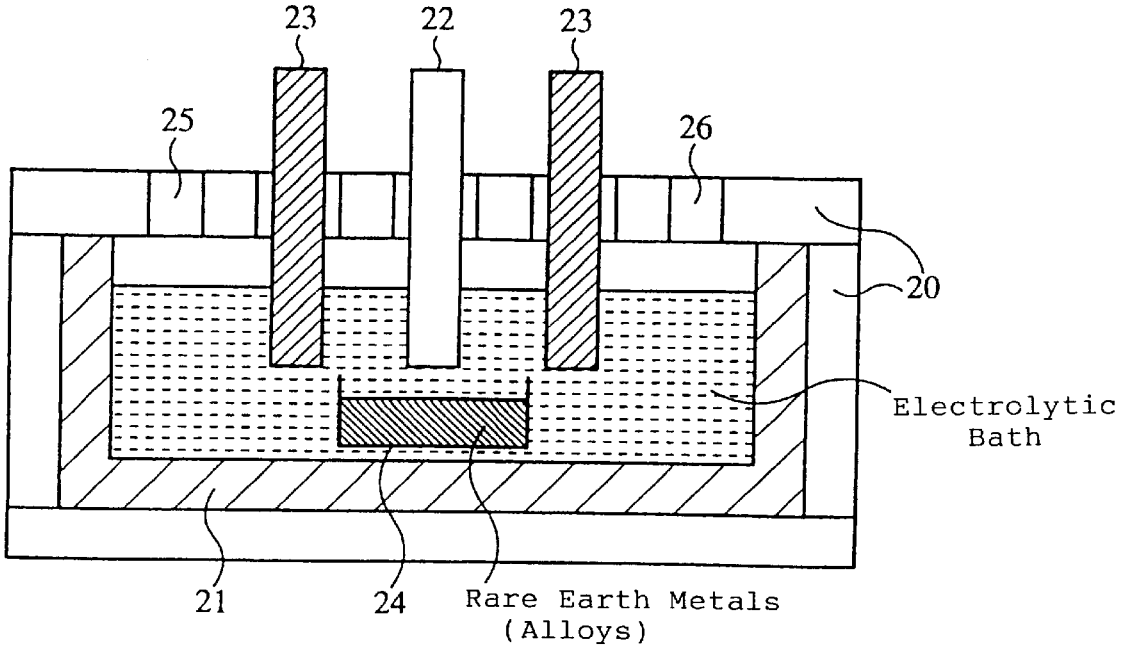
FIG. 2 is a schematic view showing a molten salt electrolytic cell equipped with consumable electrodes arranged in parallel, as another example of the electrolytic cell used in the present invention.

The electrolysis may be performed, for example, by charging a previously molten mixed fluoride salt electrolytic bath in an electrolytic cell as exemplified in FIG. 1 or 2, supplying alternating current between the electrodes for heating the bath with the heat generated by the resistance of the electrolytic bath to raise the bath temperature up to a predetermined temperature, charging the starting material containing rare earth carbonates as main ingredients into the bath, and supplying direct current when the carbonates are reacted and dissolved, thereby electrolyzing the starting material. It is preferred to start continuous charging of the starting material containing rare earth carbonates as main ingredients at a constant ratio simultaneously with the commencement of the electrolysis for keeping the concentration of the carbonates and the like in the electrolysis bath constant, and continue the electrolysis. The precipitated rare earth metals (alloys) are drawn up at regular time intervals. For example, the molten metals accumulated at the bottom of the electrolytic cell of FIG. 1, or in the metal receiving vessel 24 of the electrolytic cell of FIG. 2, are drawn up. As the electrolytic conditions, the bath temperature is 750 to 950° C. As to other conditions, the anodic current density is preferably 0.6 to 5 A/cm$^2$, the cathodic current density is preferably 5 to 12 A/cm$^2$, and the voltage is preferably 6 to 10 V DC for adjusting the anode potential to the electrolytic potential of fluorides, though this voltage may depend on the configuration of the electrolytic cell, the anodic current density, the cathodic current density, and the amount of the bath salt charged. If the bath temperature is lower than 750° C., the charged rare earth carbonates are lowered in reactivity (to be described later) and heat-decomposed to form oxides, which are sedimented and accumulated to interrupt the progress of the electrolysis. If the bath temperature is higher than 950° C., wearing of the electrolytic cell and the electrodes is accelerated, and the potential cannot be maintained stably at the electrolytic potential of fluorides to enter the region of the electrolytic potential of oxides, so that the desired object cannot be achieved.

According to the present invention, lives of the electrolytic cell and the electrodes can be prolonged, and generation of toxic fluorine-containing gas is suppressed, by performing the electrolysis at a low bath temperature. It is believed that such effects can be obtained since reaction proceeds in accordance with the following formulae by using the rare earth carbonates as the starting material and adopting the electrolytic conditions mentioned above. (In the formula, R stands for rare earth elements.)

$2RF_3 \rightarrow 2R^{3+} + 6F^-$ $6F^- \rightarrow 6F + 6e$ (reaction at electrolytic potential of fluorides)

$R_2(CO_3)_3 + 6F \rightarrow 2RF_3 + 3O + 3CO_2\uparrow$ or $R_2O(CO_3)_2 + 6F \rightarrow 2RF_3 + 3O + 2CO_2\uparrow$ or $R_2O_2CO_3 + 6F \rightarrow 2RF_3 + 3O + CO_2\uparrow$ $3O + 3/2C \rightarrow 3/2CO_2$ (reaction on the surface of graphite anode)

In this way, the rare earth fluorides in the bath are decomposed at the anode to generate fluorine ions, which become nascent fluorine near the anode. This nascent fluorine immediately reacts with the charged rare earth carbonates or rare earth carbonates intermediately decomposed by heat of the bath, to form rare earth fluorides, with only carbonic acid gases being generated. Accordingly, generation of toxic fluorine-containing gases, which are generated in the conventional fluoride electrolysis employing only fluorides, can be effectively suppressed. Further, there will never occur the problems raised in the conventional electrolysis with a charge of only oxides, that the oxides are sedimented at the bottom of the electrolytic cell to form a slug before the oxides are completely dissolved in the bath salt and dissociated into ions thereafter. The decomposing reaction of carbonates into oxides is an endothermic reaction, and thus it is usually believed that direct charge of carbonates into the electrolytic cell will lower the temperature of the electrolytic cell, and thus adversely affect the electrolytic reaction. However, according to the process of the present invention, the above decomposing reaction is made to proceed simultaneously with fluorinating reaction by adjusting the anode potential to the electrolytic potential of fluorides, thereby preventing the adversely affecting temperature drop. Therefore, ionization of rare earth elements can be promoted to preferably affect the electrolytic reaction. As a secondary effect, the carbonic acid gases generated in the decomposition of the rare earth carbonates cover the surface of the electrolytic bath and around a high temperature portion of the electrode in the electrolytic cell to shut out the atmosphere. Therefore, atmospheric oxidation of the anode graphite can be prevented, and thus, in cooperation with the lowered bath temperature, the life of the electrode can be prolonged. Accordingly, the electrolytic reaction proceeds at a higher current density and a higher current efficiency, and lasts for a prolonged time, enabling the prolonged production of the rare earth metals (alloys).

According to the process of the present invention, by using a consumable cathode as the cathode in the electrolytic cell, the rare earth metals may be obtained in the form of a rare earth-containing alloy corresponding to the consumable cathode. Examples of the consumable cathode may include an iron cathode, a nickel cathode, a cobalt cathode, a chromium cathode, a copper cathode, or the like.

With the process of the present invention, the rare earth carbonate-containing material is used as a main ingredient of the starting material; the electrolysis of the fluoride-containing bath salt with controlled low bath temperature is employed; and the anode potential is adjusted. Thus, electrolytic production of rare earth metals at a higher current density and a higher current efficiency is realized, and the lives of the electrolytic cell and the electrodes can be prolonged. Further, generation of fluorine-containing gases can be suppressed for avoiding need for an expensive exhaust gas treatment plant. Therefore, rare earth metals including rare earth-containing alloys can be produced at lower cost.

EXAMPLES

The present invention will now be explained in more detail with reference to Examples and Comparative Examples, but the present invention is not limited thereto.

EXAMPLE 1

Preparation of Rare Earth Carbonates

To a rare earth nitrate solution (containing lanthanum, cerium, praseodymium, and neodymium), ammonium bicarbonate was added in accordance with a conventional method, to form a precipitate. The precipitate was separated by filtration and washed, thereby preparing rare earth carbonate hydrates. The rare earth carbonate hydrates were charged in an electric furnace, and subjected to a drying treatment at 350° C. for 10 hours, thereby producing rare earth carbonates. The composition of the rare earth carbonates thus obtained was, in terms of oxides, 71.4% by weight of rare earth oxides, in which the ratio of each rare earth element was 25.0% by weight of $La_2O_3$, 50.0% by weight of $CeO_2$, 5.0% by weight of $Pr_6O_{11}$, and 20.0% by weight of $Nd_2O_3$. The moisture content of the rare earth carbonates was 0.15%.

<Electrolysis>

Using an electrolytic cell as shown in FIG. 1 (a graphite anode was used as the anode 13 and a molybdenum cathode as the cathode 14), the rare earth carbonates were electrolyzed. For the electrolysis, 10 kg of a mixed bath salt composed of 63% by weight of rare earth fluorides containing the same composition of rare earth metals as that of the rare earth metals in the rare earth carbonates, 25% by weight of lithium fluoride, and 12% by weight of barium fluoride, was melted in another electric furnace in advance, and transferred to the electrolytic cell of FIG. 1. Then alternating current was supplied between the electrodes of the electrolytic cell to raise the temperature of the molten bath salt up to 850° C. by resistance heating of the molten salt bath. At this point, the current was switched to direct current, and the electrolysis was performed using a constant-current controller manufactured by SANSHA ELECTRIC MFG. CO., LTD. (trade name "Super Mini-Rex 500") at the direct current of 100 A, the interelectrode voltage of 10.0 V, the anodic current density of 1.4 to 1.8 A/cm$^2$, and the cathodic current density of 6.3 A/cm$^2$. When the flow of the current became stable, a pure titanium cylindrical rod with a diameter of 3 mm was immersed in the electrolytic bath near the anode, and the anode potential was measured using this rod as a reference electrode. The interelectrode voltage-was precisely adjusted so that the anode potential was within the range of the electrolytic potential of fluorides. When the anode potential became stable at about 5.4 V, the starting rare earth carbonate material was continuously charged into the cell through the port 15 at a rate of 241 g per hour. The precipitated rare earth metals were drawn up every 24 hours, and were cast in molds to produce misch metal ingots. Since the anode 13 was consumed, it was replaced with a new one when the particular current density cannot be maintained. After 2160 hours, the electrolysis was temporarily stopped, though it was still possible to continue the electrolysis. The integrated current amount during that period was 216000 Ah, the amount of rare earth carbonates charged was 520 kg, the amount of misch metal obtained was 309 kg, and the current efficiency was 96%. Almost no sediment was accumulated at the bottom of the cell. The electrolysis could be resumed in a good condition. During the electrolysis, almost no fluorine-containing gas was generated.

EXAMPLE 2

Preparation of Rare Earth Carbonates

To a nitrate solution of neodymium and praseodymium, ammonia bicarbonate was added in accordance with a conventional method, to form a precipitate. The precipitate was separated by filtration, washed, and subsequently dried in an electric furnace at 500° C. for 10 hours, thereby preparing rare earth carbonates. The obtained rare earth carbonates contained 66.2% by weight of $Nd_2O_3$ and 1.4% by weight of $Pr_6O_{11}$ in terms of oxides, and the moisture content of the rare earth carbonates was less than 0.1%.

<Electrolysis>

Using an electrolytic cell as shown in FIG. 2 wherein the anodes were made of graphite, the cathode of pure iron, and the metal receiving vessel of molybdenum, the rare earth carbonates were electrolyzed. For the electrolytic bath salt, 15 kg of a mixed bath salt composed of 50% by weight of neodymium fluoride, 30% by weight of lithium fluoride, and 20% by weight of barium fluoride was melted in another electric furnace in advance, and transferred to the electrolytic cell of FIG. 2. Then alternating current was supplied as in Example 1 to raise the bath temperature up to 920° C., and the current was switched to direct current. The electrolysis was performed using the constant-current controller manufactured by SANSHA ELECTRIC MFG. CO., LTD. at the direct current of 100 A, the interelectrode voltage of 9.2 V, the anodic current density of 1.0 to 1.4 A/cm$^2$, and the cathodic current density of 7.5 to 9 A/cm$^2$. When the flow of the current became stable, the starting rare earth carbonate material was continuously charged into the cell at a rate of 294 g per hour, while the anode potential was adjusted to 5.2 V, as in Example 1. The precipitated neodymium-praseodymium-iron alloy was drawn up from the metal receiving vessel 24 at regular time intervals, and was cast in molds to produce neodymium-iron master alloys. Since the cathode and the anodes were consumed, they were replaced with new ones when the particular current density cannot be maintained. After 2160 hours, the electrolysis was temporarily stopped. The integrated current amount during this period was 216000 Ah, and the amount of carbonates charged was 634 kg. The average composition of neodymium-praseodymium-iron alloys obtained was 83.3% by weight of neodymium, 1.7% by weight of praseodymium, and 15.0% by weight of iron, and the amount of the alloys was 432 kg. The current efficiency was 95%. Almost no sediment was accumulated at the bottom of the cell. The electrolysis could be resumed in a good condition. During the electrolysis, almost no fluorine-containing gas was generated.

EXAMPLE 3

Using the electrolytic cell as shown in FIG. 1 (a graphite anode was used as the anode, and a molybdenum cathode was used as the cathode), the rare earth carbonates as prepared in Example 1 were electrolyzed. The electrolysis was performed in a similar manner as in Example 1, except that a 100 g-piece of nickel metal mass was placed in advance on the surface of the cathode 14 at the bottom of the cell. Additional nickel metal was place on the cathode at regular time intervals. The electrolysis was performed at the bath temperature of 780° C., the current of 100 A, the interelectrode voltage of 9.8 V, the anodic current density of 1.5 to 2 A/cm$^2$, the cathodic current density of 5.5 to 6.0 A/cm$^2$, and the anode potential of 5.5 V, with the carbonates being charged at a rate of 243 g per hour. The integrate current amount during the consecutive 2160 hours of electrolysis was 216000 Ah, the amount of carbonates charged was 526 kg, the amount of nickel metal charged was 69 kg, and the amount of rare earth-nickel alloys obtained was 381 kg. The average composition of the rare earth-nickel alloys was 18.0% by weight of nickel and 82.0% by weight of rare earth metals. The current efficiency was 97%. Almost no sediment was accumulated at the bottom of the cell. The electrolysis could be resumed in a good condition. Almost no fluorine gas was generated.

Comparative Example 1

The rare earth carbonate hydrates before drying as prepared in Example 1 were charged in a heat resisting vessel, and calcined in an electric furnace at 800° C. for 10 hours to obtain oxides. Using the oxides thus obtained as the starting material for electrolysis, the electrolysis was performed in the same way as in Example 1 except that the bath temperature was 850° C., the current was 100 A, the interelectrode voltage was 10.2 V, the anode potential was 5.4 V, the anodic current density was 1.0 to 1.5 A/cm$^2$, the cathodic current density was 6.0 A/cm$^2$, and the charging rate of the starting oxide material was 147.5 g per hour. After consecutive 1440 hours, the cell bottom was filled with sediments, thereby interrupting the electrolysis. Thus, the electrolysis was stopped. The integrate current amount by the time of the stoppage of the electrolysis was 144000 Ah, the amount of oxides charged was 212.4 kg, the amount of misch metal obtained was 179 kg, and the current efficiency was 83%. Generation of fluorine-containing gases was recognized.

Comparative Example 2

The rare earth carbonate hydrates before drying as prepared in Example 2 were charged in a heat resisting vessel, and calcined in an electric furnace at 850° C. for 10 hours to obtain oxides. Using the oxides thus obtained as the starting material for electrolysis, the electrolysis was performed in the same way as in Example 2 except that the bath temperature was 920° C., the current was 100 A, the interelectrode voltage was 9.3 V, the anode potential was 5.2 V, the anodic current density was 1.1 to 1.6 A/cm$^2$, the cathodic current density was 7.5 to 9 A/cm$^2$, and the charging rate of the staring oxide material was 167 g per hour. After consecutive 1800 hours, the cell bottom was filled with sediments, thereby interrupting the electrolysis. Thus, the electrolysis was stopped. The integrated current amount by the time of the stoppage of the electrolysis was 180000 Ah, the amount of oxides charged was 300 kg, the amount of neodymium-praseodymium-iron master alloys was 340 kg, of which average composition was 78.7% by weight of neodymium, 1.8% by weight of praseodymium, and 19.5% by weight of iron, and the current efficiency was 85%. Generation of fluorine-containing gases was recognized.

Comparative Example 3

Using the starting oxide material as prepared in Comparative Example 1, the electrolysis was performed in the same way as in Example 3 except that the bath temperature was 780° C., the current was 100 A, the interelectrode voltage was 11.0 V, the anode potential was 5.5 V, the anodic current density was 1.3 to 1.5 A/cm$^2$ the cathodic current density was 5.0 to 5.2 A/cm$^2$, and the charging rate of the starting oxide material was 156.4 g per hour. The electrolysis could last for 2160 hours consecutively, but at the end of that period, sediments were accumulated at the bottom of the cell. The sediments could hardly be removed from the alloy, thereby giving the alloy containing a considerable amount of slug (the sediments). The integrated current amount was 216000 Ah, the amount of oxides charged was 338 kg, the amount of rare earth-nickel alloys obtained was 324 kg, of which average composition was 22.0% by weight of nickel and 78.0% by weight of rare earth metals, and the current efficiency was 78%. Generation of fluoride-containing gases was recognized.

Comparative Example 4

The rare earth carbonate hydrates before drying as prepared in Example 2 was charged in a heat resisting vessel, and calcined in an electric furnace at 600° C. for 15 hours. The calcined material thus obtained was identified by X-ray diffraction to be carbonates of $R_2O_2CO_3$ type (R stands for rare earth elements). Using the carbonates as the starting material for electrolysis, the electrolysis was performed in the same way as in Example 2 except that the bath temperature was 1000° C., the current was 100 A, the interelectrode voltage was 7.7 V, the anode potential was 3.0 V, the anodic current density was 0.8 to 1.0 A/cm$^2$, the cathodic current density was 5 to 6 A/cm$^2$, and the charging rate of the starting material was 250 g per hour. The anode potential in this case (3.0 V) corresponds to the electrolytic potential of oxides. As a result, after the 800-hour electrolysis, the cell body and the electrode supports were remarkably worn, and thus prolonged operation was given up. The current efficiency by that time was 88%.

What is claimed is:

1. A process for producing rare earth metals comprising the step of electrolyzing a starting material containing rare earth carbonates as main ingredients in a molten salt electrolytic bath containing rare earth fluorides, lithium fluoride, and barium fluoride at a bath temperature of 750 to 950° C. while adjusting an anode potential to an electrolytic potential of fluorides.

2. The process as claimed in claim 1 wherein a content of said rare earth carbonates in said starting material containing rare earth carbonates is not less than 70% by weight, and a moisture content of said rare earth carbonates is not more than 0.2% by weight.

3. The process as claimed in claim 1 wherein said rare earth carbonates are selected from the group consisting of normal carbonates of rare earths, monooxycarbonates of rare earths, dioxycarbonates of rare earths, and mixtures thereof.

4. The process as claimed in claim 1 wherein said molten salt electrolytic bath further contains a metal capable of forming an alloy with rare earths, said metal being selected from the group consisting of nickel, cobalt, chromium, manganese, copper, aluminum, magnesium, zinc, and mixtures thereof.

5. The process as claimed in claim 1 wherein said electrolytic potential of fluorides is 4.5 to 6 V.

6. The process as claimed in claim 1 wherein said electrolyzing step is performed at an anodic current density of 0.6 to 5 $A/cm^2$ and a cathodic current density of 5 to 12 $A/cm^2$, and at a voltage of 6 to 10 V DC.

7. The process as claimed in claim 1 wherein said electrolyzing step is performed in an electrolytic cell equipped with a consumable electrode.

8. The process as claimed in claim 1 wherein said rare earth metals to be obtained is selected from the group consisting of rare earths, rare earth-containing alloys, and mixtures thereof.

* * * * *